US008701606B2

(12) United States Patent
Tateno

(10) Patent No.: US 8,701,606 B2
(45) Date of Patent: Apr. 22, 2014

(54) VARIABLE COMPRESSION RATIO V-TYPE INTERNAL COMBUSTION ENGINE

(75) Inventor: Manabu Tateno, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 224 days.

(21) Appl. No.: 13/388,869

(22) PCT Filed: Sep. 3, 2010

(86) PCT No.: PCT/JP2010/065575
§ 371 (c)(1),
(2), (4) Date: Feb. 3, 2012

(87) PCT Pub. No.: WO2011/027914
PCT Pub. Date: Mar. 10, 2011

(65) Prior Publication Data

US 2012/0145128 A1 Jun. 14, 2012

(30) Foreign Application Priority Data

Sep. 3, 2009 (WO) ..... PCT/JP2009/065781

(51) Int. Cl.
*F02B 75/04* (2006.01)

(52) U.S. Cl.
USPC ..... 123/78 C; 123/48 C

(58) Field of Classification Search
CPC ..... F02D 15/04; F02B 75/04; F02B 75/041
USPC ..... 123/48 R, 48 C, 78 R, 78 C
See application file for complete search history.

(56) References Cited

U.S. PATENT DOCUMENTS

| | | | | |
|---|---|---|---|---|
| 5,562,069 | A * | 10/1996 | Gillbrand et al. | 123/48 C |
| 7,036,468 | B2 * | 5/2006 | Kamiyama | 123/78 R |
| 7,487,747 | B2 * | 2/2009 | Kamiyama et al. | 123/48 C |

FOREIGN PATENT DOCUMENTS

| | | |
|---|---|---|
| JP | A-2003-206771 | 7/2003 |
| JP | A-2005-113738 | 4/2005 |
| JP | A-2005-113743 | 4/2005 |
| JP | A-2005-256646 | 9/2005 |
| JP | A-2009-097449 | 5/2009 |
| JP | A-2009-293540 | 12/2009 |

OTHER PUBLICATIONS

International Search Report issued in International Application No. PCT/JP2010/065575 dated Oct. 12, 2010 (with translation).

* cited by examiner

*Primary Examiner* — Lindsay Low
*Assistant Examiner* — Hung Q Nguyen
(74) *Attorney, Agent, or Firm* — Oliff PLC

(57) ABSTRACT

A variable compression ratio V-type internal combustion engine joins the cylinder blocks of two cylinder groups together and makes the joined cylinder blocks move relative to a crankcase. The variable compression ratio V-type internal combustion engine includes a first relative movement mechanism and a second relative movement mechanism. The first relative movement mechanism and the second relative movement mechanism can be independently controlled, and a first relative movement distance at one cylinder group side of the cylinder block in the direction of the centerline of the engine which passes through the center of the crank shaft as seen in the front plan view caused by the first relative movement mechanism and a second relative movement distance at the other cylinder group side of the cylinder block in the direction of the centerline of the engine caused by the second relative movement mechanism are able to made different.

4 Claims, 7 Drawing Sheets

VARIABLE COMPRESSION RATIO V-TYPE INTERNAL COMBUSTION ENGINE

TECHNICAL FIELD

The present invention relates to a variable compression ratio V-type internal combustion engine.

BACKGROUND ART

In general, the lower the engine load, the worse the heat efficiency, so at the time of engine low load operation, the mechanical compression ratio ((top dead center cylinder volume+stroke volume)/top dead center cylinder volume) is preferably raised to raise the expansion ratio and thereby improve the heat efficiency. For this, it has been known to make the cylinder block and crankcase move relative to each other to change the distance between the cylinder block and the crankshaft and thereby make the mechanical compression ratio variable.

In a V-type internal combustion engine, it has been proposed to make the cylinder block parts of the two cylinder groups move relatively to the crankcase separately along the cylinder centerlines of the cylinder groups, but it is difficult to make different cylinder block parts move relatively to the crankcase by a single link mechanism (or cam mechanism). A pair of link mechanisms (or cam mechanisms) become necessary for each cylinder block part, so overall two pairs of link mechanisms end up becoming necessary.

To reduce the number of link mechanisms, a variable compression ratio V-type internal combustion engine has been proposed which joins the cylinder blocks of two cylinder groups and makes the joined cylinder blocks move relatively to the crankcase by a pair of link mechanisms (refer to Japanese Patent Publication (A) No. 2005-113743, Japanese Patent Publication (A) No. 2005-256646, Japanese Patent Publication (A) No. 2005-113738, and Japanese Patent Publication (A) No. 2009-097449).

DISCLOSURE OF THE INVENTION

In the above-mentioned variable compression ratio V-type internal combustion engine, when making the cylinder block move relatively to the crankcase, if the centerline of the cylinder block between the two cylinder groups in the front view accurately matches with the centerline of the engine passing through the center of the crankshaft, at each movement position of the cylinder block, the angle between the centerline of the connecting rod at top dead center and the centerline of the cylinders in one cylinder group becomes equal to the angle between the centerline of the connecting rod at top dead center and the centerline of the cylinders in another cylinder group. It is possible to make the mechanical compression ratio of one cylinder group and the mechanical compression ratio of the other cylinder group equal.

However, in the above variable compression ratio V-type internal combustion engine, when making the cylinder block move relatively to the crankcase, in the front plan view, the centerline of the cylinder block separates from the centerline of the engine.

Further, when making the cylinder block move relatively to the crankcase, in the front plan view, even if trying to make the centerline of the cylinder block match with the centerline of the engine, sometimes, due to the clearances provided for making the cam mechanisms or link mechanisms movable, the centerline of the cylinder block will not accurately match the centerline of the engine.

In this way, when making a cylinder block move relatively to a crankcase, in the front plan view, when the centerline of the cylinder block will not accurately match the centerline of the engine, at each relative movement position, the mechanical compression ratio of one cylinder group and the mechanical compression ratio of the other cylinder group will sometimes not become equal.

Therefore, an object of the present invention is to provide a variable compression ratio V-type internal combustion engine where the cylinder blocks of two cylinder groups are joined and made to move relatively to a crankcase wherein the mechanical compression ratios of the two cylinder groups at the different relative movement positions can be adjusted to become equal.

A variable compression ratio V-type internal combustion engine as set forth in claim 1 of the present invention is provided, characterized in that the variable compression ratio V-type internal combustion engine which joins cylinder blocks of two cylinder groups and makes the joined cylinder blocks move relatively to a crankcase, comprising a first relative movement mechanism which makes one cylinder group side of the cylinder block move relatively and a second relative movement mechanism which makes the other cylinder group side of the cylinder block move relatively, the first relative movement mechanism and the second relative movement mechanism being able to be independently controlled, and a first relative movement distance at one cylinder group side of the cylinder block in the engine centerline direction passing through the center of the crank shaft as seen in the front plan view caused by the first relative movement mechanism and a second relative movement distance at the other cylinder group side of the cylinder block in the engine centerline direction caused by the second relative movement mechanism being able to made different.

A variable compression ratio V-type internal combustion engine as set forth in claim 2 of the present invention is provided as the variable compression ratio V-type internal combustion engine as set forth in claim 1 characterized in that the first relative movement mechanism is a link mechanism which has one degree of freedom and in that the second relative movement mechanism is a link mechanism which has two degrees of freedom.

A variable compression ratio V-type internal combustion engine as set forth in claim 3 of the present invention is provided as the variable compression ratio V-type internal combustion engine as set forth in claim 1 or 2 characterized in that when the first relative movement distance and the second relative movement distance are changed, the difference between a combustion pressure representing one cylinder group and a combustion pressure representing the other cylinder group is made to become within an allowable range by using the first relative movement mechanism for feedback control of the first relative movement distance or by using the second relative movement mechanism for feedback control of the second relative movement distance.

According to the variable compression ratio V-type internal combustion engine as set forth in claim 1 of the present invention, the variable compression ratio V-type internal combustion engine which joins cylinder blocks of two cylinder groups and makes the joined cylinder blocks move relatively to a crankcase, comprises a first relative movement mechanism which makes one cylinder group side of the cylinder block move relatively and a second relative movement mechanism which makes the other cylinder group side of the cylinder block move relatively, the first relative movement mechanism and the second relative movement mechanism being able to be independently controlled, and a first relative movement distance at one cylinder group side of the cylinder block in the engine centerline direction passing through the center of the crank shaft as seen in the front plan view caused by the first relative movement mechanism and a second relative movement distance at the other cylinder group side of the cylinder block in the engine centerline direction caused by the second relative movement mechanism being able to made different. By making the first relative movement distance and second relative movement distance different in this way and, in the front plan view, making the centerline of the cylinder block slanted with respect to the centerline of the engine, if the first relative movement distance and the second relative movement distance are made equal, when the mechanical compression ratio of one cylinder group and the mechanical compression ratio of the other cylinder group differ, the mechanical compression ratio of one cylinder group and the mechanical compression ratio of the other cylinder group can be made substantially equal.

According to the variable compression ratio V-type internal combustion engine as set forth in claim 2 of the present invention, in the variable compression ratio V-type internal combustion engine as set forth in claim 1, the first relative movement mechanism is a link mechanism which has one degree of freedom and the second relative movement mechanism is a link mechanism which has two degrees of freedom. Due to this, it is possible to easily make the first relative movement distance at one cylinder group side of the cylinder block caused by the first relative movement mechanism and the second relative movement distance at the other cylinder group side of the cylinder block caused by the second relative movement mechanism different.

According to the variable compression ratio V-type internal combustion engine as set forth in claim 3 of the present invention, in the variable compression ratio V-type internal combustion engine as set forth in claim 1 or 2, when the first relative movement distance and the second relative movement distance are changed, the difference between a combustion pressure representing one cylinder group and a combustion pressure representing the other cylinder group is made to become within an allowable range by using the first relative movement mechanism for feedback control of the first relative movement distance or by using the second relative movement mechanism for feedback control of the second relative movement distance, due to which, either of the mechanical compression ratio of one cylinder group and the mechanical compression ratio of the other cylinder group may be adjusted to make the combustion pressure of one cylinder group and the combustion pressure of the other cylinder group substantially equal.

DESCRIPTION OF EMBODIMENTS

Figure 1:
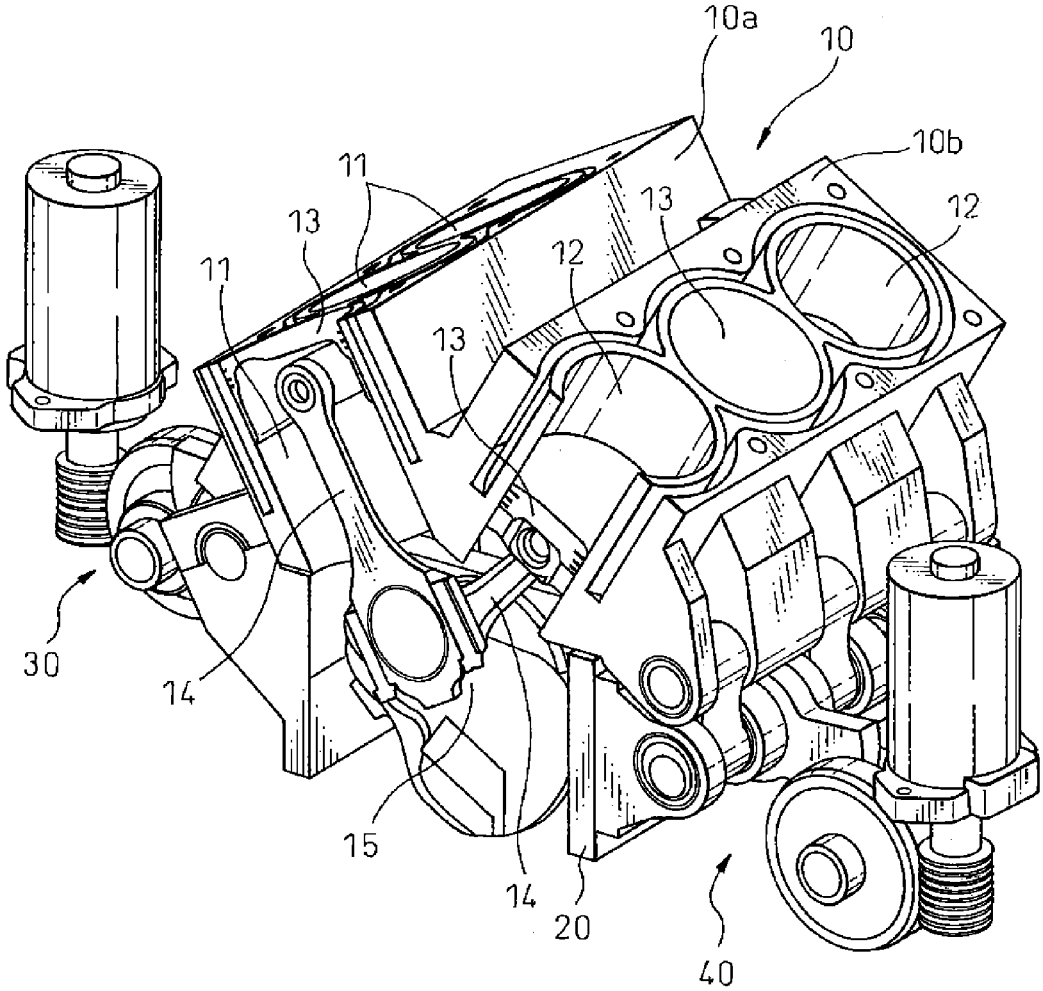
FIG. 1 is a perspective view showing part of a variable compression ratio V-type internal combustion engine according to the present invention.

FIG. 1 is a perspective view showing part of a variable compression ratio V-type internal combustion engine according to the present invention. In the figure, 10 indicates a cylinder block, 20 a crankcase, 30 a first relative movement mechanism of a first cylinder group side, and 40 a second relative movement mechanism of a second cylinder group side. The cylinder block 10 is comprised of a first cylinder group side part 10*a* and a second cylinder group side part 10*b* formed integrally. Inside first cylinder group side cylinder bores 11 and second cylinder group side cylinder bores 12, pistons 13 are arranged. The pistons 13 are connected by a connecting rod 14 to a crank shaft 15.

This V-type internal combustion engine is a spark ignition type. The first cylinder group side part 10*a* and the second cylinder group side part 10*b* of the cylinder block 10 are mounted with cylinder heads (not shown). At the cylinder heads, spark plugs are provided for each cylinder bore. At each cylinder head, intake ports and exhaust ports are formed. Each intake port is communicated through an intake valve to a corresponding cylinder bore, while each exhaust port is communicated through an exhaust valve to a corresponding cylinder bore 11. For each cylinder head, an intake manifold and exhaust manifold are connected. The intake manifolds open to the atmosphere via an air cleaner either independently of each other or by merging, while the exhaust manifolds are also open to the atmosphere via a catalyst device either independently of each other or by merging. Further, the V-type internal combustion engine may be a diesel engine as well.

In general, the lower the engine load, the worse the heat efficiency, so at the time of engine low load operation, if raising the mechanical compression ratio to raise the expansion ratio, it is possible to improve the heat efficiency due to the work time of the pistons in the expansion stroke becoming longer. The mechanical compression ratio becomes the ratio of the cylinder volume V1 at the top dead center crank angle and the stroke volume V2 with respect to the cylinder volume V1 at the top dead center crank angle, that is, (V1+V2)/V1, and is equal to the expansion ratio of the expansion stroke. Due to this, the V-type internal combustion engine uses the first relative movement mechanism 30 and the second relative movement mechanism 40 to make the cylinder block 10 move relatively to the crankcase 20. By changing the distance between the cylinder block 10 and the crank shaft 15, the mechanical compression ratios of the first cylinder group and the second cylinder group are made variable. For example, the mechanical compression ratio is controlled so that the lower the engine load, the higher the mechanical compression ratio is made.

Figure 2:
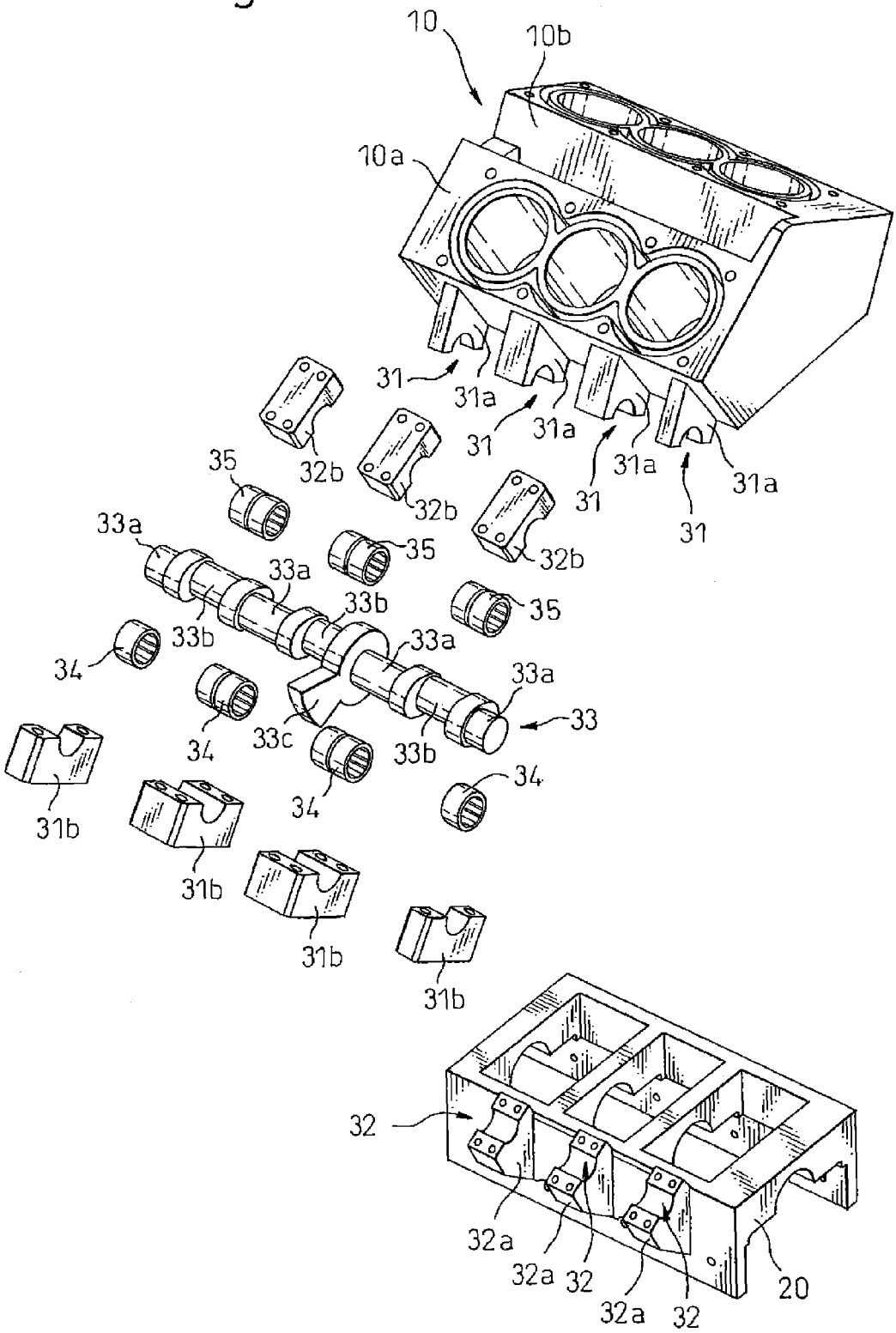
FIG. 2 is a disassembled perspective view of a first relative movement mechanism which is provided at the variable compression ratio V-type internal combustion engine of FIG. 1.

The first relative movement mechanism 30, as shown in FIG. 2, has a plurality of cylinder block side first bearing parts (illustrated as four) 31 which are provided at a lower side surface of the first cylinder group side part 10*a* of the cylinder block 10 and a plurality of crankcase side first bearing parts (illustrated as three) 32 which are provided at an upper side surface of the first cylinder group side of the crankcase 20, the cylinder block side first bearing parts 31 and crankcase side first bearing parts 32 alternately positioned and supporting a single first shaft 33. In this way, the first cylinder group side part 10*a* of the cylinder block 10 and the first cylinder group side of the crankcase 20 are connected through the first shaft 33.

The cylinder block side first bearing part 31 and the crankcase side first bearing part 32 are split into the two pieces 31*a* and 31*b* and 32*a* and 32*b* to enable support of the first shaft 33. The first shaft 33 has a plurality of cylinder block side support parts 33*a* which are supported by the cylinder block side first bearing parts 31 and a plurality of crankcase side support parts 33*b* which are supported by the crankcase side first bearing parts 32. The cylinder block side support parts 33*a* are concentric with each other, while the crankcase side support parts 33*b* are concentric with each other. However, the cylinder block side support parts 33*a* and the crankcase side support parts 33*b* are eccentric. Reference numeral 34 shows bearing elements which are fit at the cylinder block side support parts 33*a*, while 35 shows bearing elements which are fit at the crankcase side support parts 33*b*. These are split into two to enable fitting at the cylinder block side support parts 33*a* and crankcase side support parts 33*b*. Reference numeral 33*c* shows a fan-shaped gear which is concentric with the crankcase side support part 33*b* of the first shaft 33.

Figure 4:
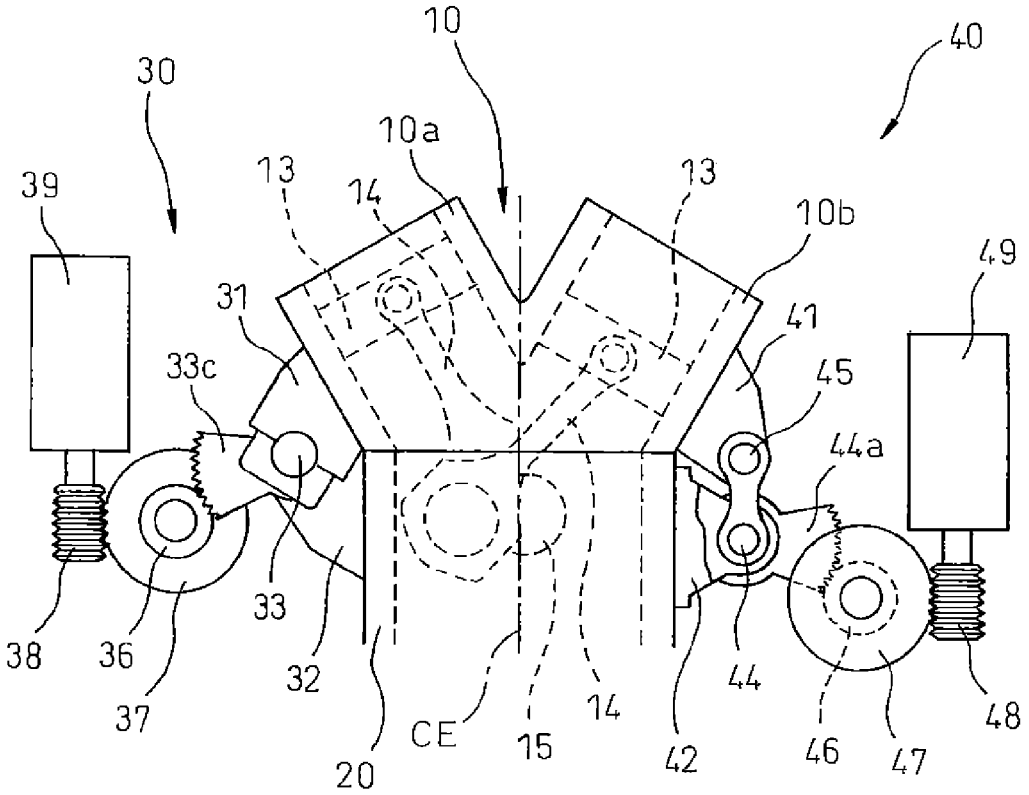
FIG. 4 is a front view showing part of a variable compression ratio V-type internal combustion engine according to the present invention.

As shown in FIG. 4, the fan-shaped gear 33*c* engages with the small diameter gear 36, while a large diameter gear 37 concentric with the small diameter gear 36 engages with a worm gear 38 of the first motor 39. By operating the first motor 39 and making the worm gear 38 rotate in this way, it is possible to make the first shaft 33 rotate about the crankcase side support part 33*b* through the large diameter gear 37, small diameter gear 36, and the fan-shaped gear 33*c*.

Figure 3:
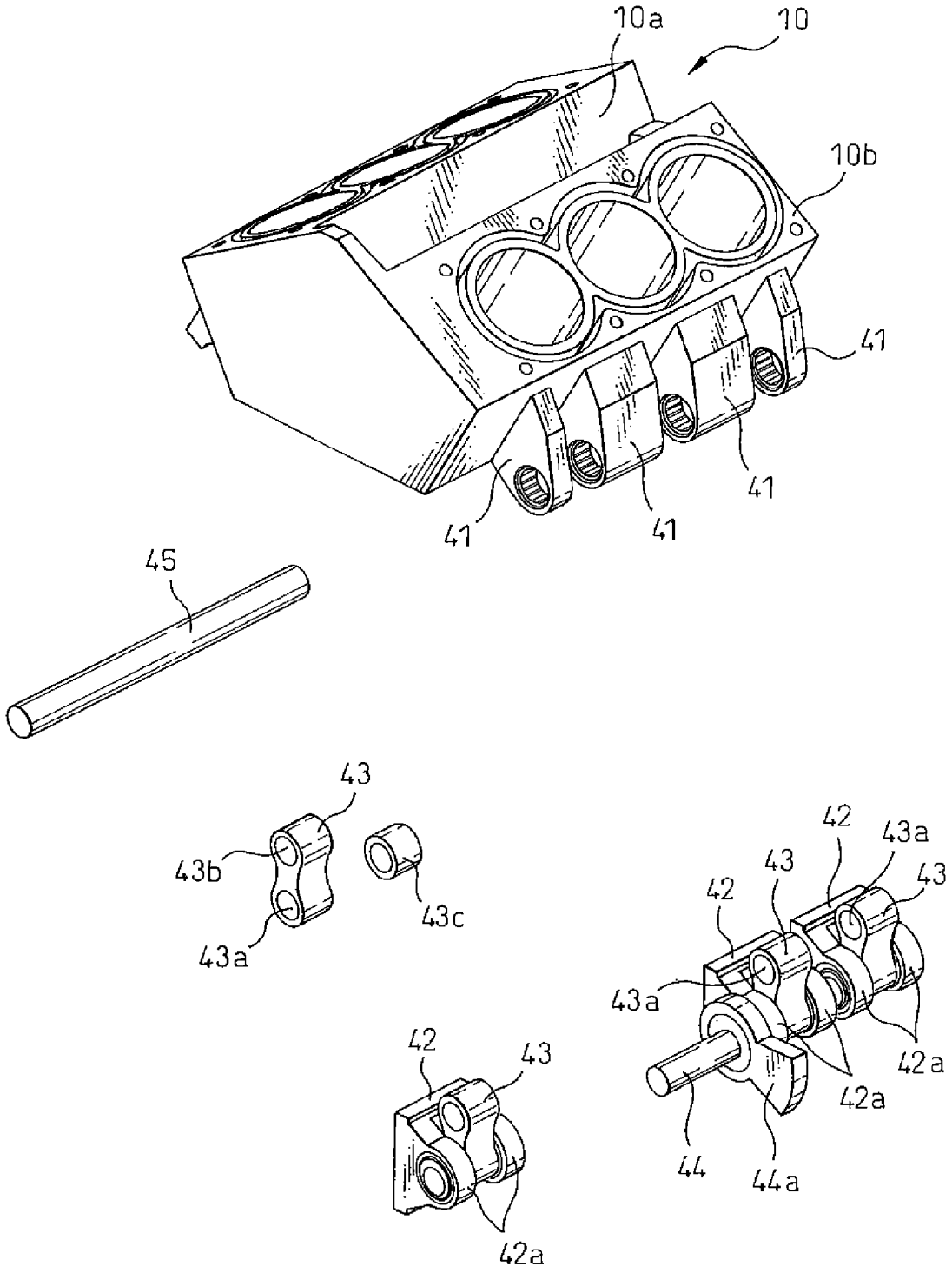
FIG. 3 is a disassembled perspective view of a second relative movement mechanism which is provided at the variable compression ratio V-type internal combustion engine of FIG. 1.

On the other hand, the second relative movement mechanism 40, as shown in FIG. 3, has a plurality of cylinder block side second bearing part (illustrated as four) 41 which are provided at a lower side surface of the second cylinder group side part 10*b* of the cylinder block 10 and a plurality of crankcase side second bearing parts (illustrated as three) 42 which are attached to an upper side surface of the second cylinder group side of the crankcase 20. Each crankcase side second bearing parts 42 has two bearings 42*a*. Between the two bearings 42*a*, an arm 43 is inserted. The arm 43 has at its ends a first through hole 43*a* and a second through hole 43*b*. Inside the first through hole 43*a*, an eccentric boss 43*c* is inserted. A second shaft 44 passes through the two bearings 42*a* of the crankcase side second bearing parts 42 and passes through the eccentric holes of the eccentric bosses 43*c* which are inserted into the first through holes 43*a* of the arms 43. Further, a third shaft 45 passes through the cylinder block side second bearing parts 41 and second through holes 43*b* of the arms 43 positioned between two cylinder block side second bearing parts 41. In this way, the second cylinder group side part 10*b* of the cylinder block 10 and the second cylinder group side of the crankcase 20 are connected through the second shaft 44 and the third shaft 45.

The bearings 42*a* of the cylinder block side second bearing part 41 and the crankcase side second bearing part 42 are provided with bearing elements. Reference numeral 44*a* shows a fan-shaped gear which is concentric with the second shaft 44. As shown in FIG. 4, the fan-shaped gear 44*a* engages with the small diameter gear 46, while a large diameter gear 47 which is concentric with the small diameter gear 46 engages with a worm gear 48 of the second motor 49. In this way, the second motor 49 is operated to make the worm gear 48 rotate, whereby the second shaft 44 is made to rotate through the large diameter gear 47, the small diameter gear 46, and the fan-shaped gear 44*a*. The eccentric bosses 43*c*, which are joined with the second shaft 44 by insertion into the eccentric holes, can be made to rotate about the second shaft 44 at the first through holes 43*a* of the arms 43.

Figure 5:
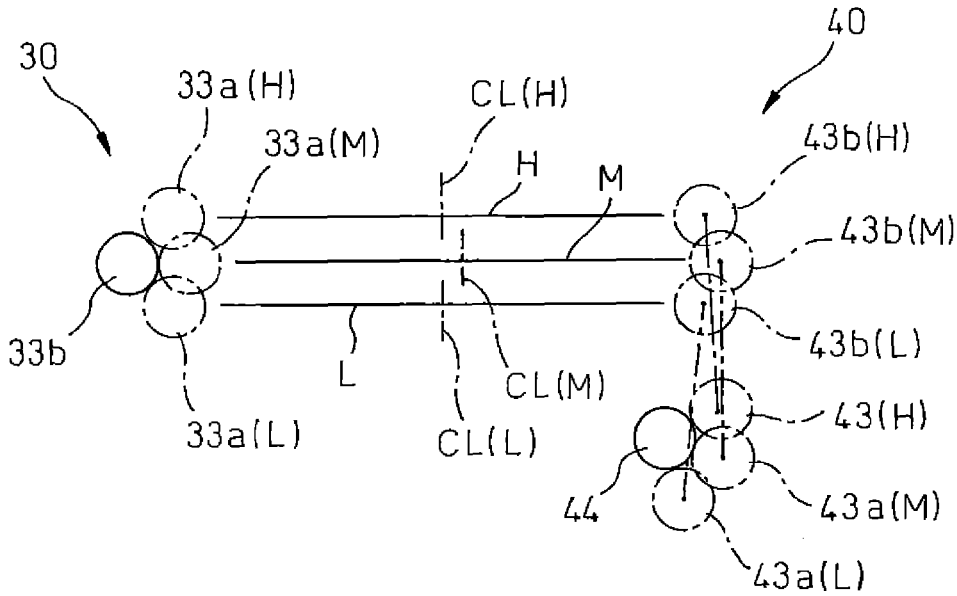
FIG. 5 is a view explaining the operations of the first relative movement mechanism and the second relative movement mechanism.
Figure 6:
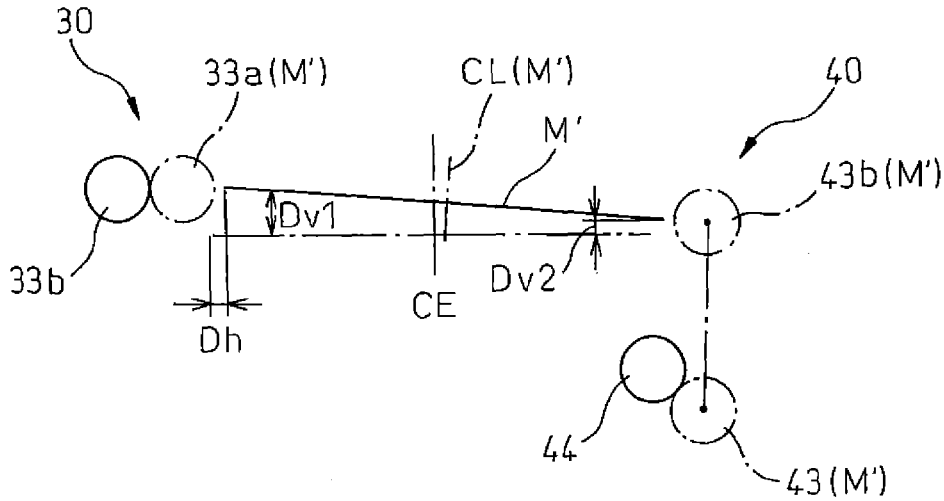
FIG. 6 is another view explaining the operations of the first relative movement mechanism and the second relative movement mechanism.

FIGS. 5 and 6 are views for explaining the operation of the first relative movement mechanism 30 and second relative movement mechanism 40. In FIG. 5, L indicates a low position of the bottom of the cylinder block 10, M indicates a median position of the bottom of the cylinder block 10, and H indicates a high position of the bottom of the cylinder block 10. In FIG. 5, CL(L), CL(M), and CL(H) show the centerlines of the cylinder block CL between two cylinder groups at the different positions of a cylinder block. FIG. 5 shows the case at each cylinder block position where the cylinder block is made to move so that the centerline of the cylinder block CL becomes parallel with the centerline of the engine. Here, the "centerline of the cylinder block" is the centerline, in the front plan view, between the cylinder centerline of the first cylinder group and the cylinder centerline of the second cylinder group. Further, the centerline of the engine is shown by CE in FIG. 4. In the front plan view, it is the centerline which passes through the center of the crank shaft 15. In general, it is a vertical line passing through the center of the crank shaft.

Figure 7:
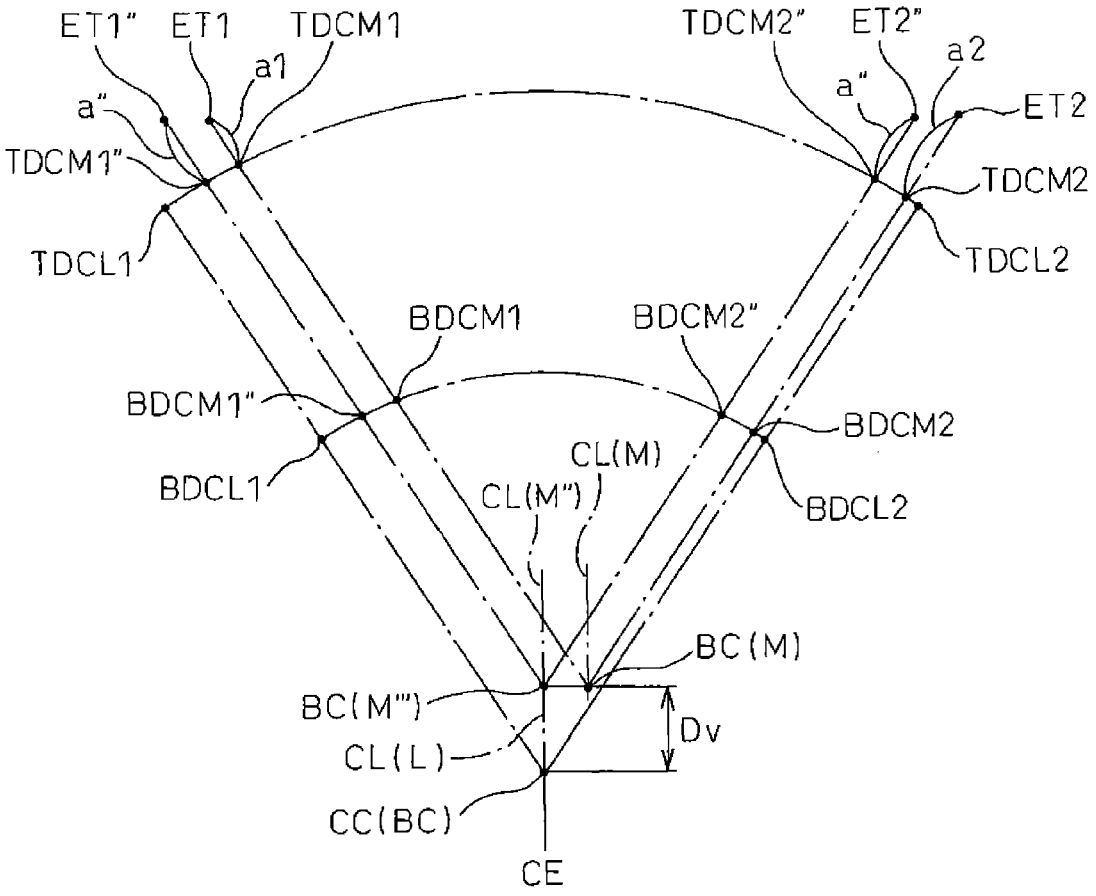
FIG. 7 is a view explaining a change of the mechanical compression ratio.

FIG. 7 shows the top dead center positions TDCL1 and TDCM1 and bottom dead center positions BDCL1 and BDCM1 of the piston pin centers of the cylinders of the first cylinder group and the top dead center positions TDCL2 and TDCM2 and bottom dead center positions BDCL2 and BDCM2 of the piston pin centers of the cylinders of the second cylinder group at the low position of the cylinder block 10 where the centerline of the cylinder block CL matches with the centerline of the engine CE (low position L of FIG. 5) and at the median position of the cylinder block 10 where the centerline of the cylinder block CL separates from the centerline of the engine CE in parallel with it (median position M of FIG. 5). In the present embodiment, at the low position of the cylinder block 10 (low position L of FIG. 5), the front view crossing point BC between the cylinder centerline of the first cylinder group and the cylinder centerline of the second cylinder group matches the center CC of the crank shaft 15.

When making the cylinder block 10 move relative to the crankcase 20 in the direction of the centerline of the engine CE by exactly Dv, as the median position shown in FIG. 7, if the centerline of the cylinder block CL separates from the centerline of the engine CE in parallel to the second cylinder group side, ET1 and ET2 are virtual top dead center positions of the piston pin centers of the first cylinder group and the piston pin centers of the second cylinder group in the case of the crank shaft moving together with the cylinder block. In the first cylinder group and the second cylinder group, the top dead center positions of the piston pin centers descend from ET1 and ET2 to the respective actual positions TDCM1 and TDCM2 (to approach crank angle 15), so the cylinder volume of the top dead center crank angle becomes larger. On the other hand, the stroke volume (between TDCL1 and BDCL1, between TDCL2 and BDCL2, between TDCM1 and BDCM1, and between TDCM2 and BDCM2) does not change much at all (strictly speaking changes slightly). Due to this, at each of the first cylinder group and the second cylinder group, the mechanical compression ratio is made smaller, but movement of the cylinder block 10 in the second cylinder group direction, as shown in FIG. 7, causes the distance a2 from the virtual top dead center position ET2 of the piston pin centers of the cylinders of the second cylinder group to the actual top dead center position TDCM2 to become larger than the distance a1 from the virtual top dead center position ET1 of the piston pin centers of the cylinders of the first cylinder group to the actual top dead center position TDCM1. As a result, the cylinder volume of the top dead center crank angle of the second cylinder group becomes larger than that of the first cylinder group, so the mechanical compression ratio of the second cylinder group is made smaller than the mechanical compression ratio of the first cylinder group. Due to this, up to now, the engine generated output of the first cylinder group and the engine generated output of the second cylinder group differ and engine vibration ends up occurring.

Further, in FIG. 7, TDCM1" and BDCM1" are the top dead center positions and bottom dead center positions of the piston pin centers of the cylinders of the first cylinder group at the median position of the cylinder block 10 where the centerline of the cylinder block CL matches the centerline of the engine CE (amount of movement Dv in direction of the centerline of the engine CE is same as median position M of FIG. 5), and TDCM2" and BDCM2" are the top dead center positions and bottom dead center positions of the piston pin centers of the cylinders of the second cylinder group at the same median position of the cylinder block 10. ET1" and ET2" are virtual top dead center positions of the piston pin centers of the cylinders of the first cylinder group and the second cylinder group in this case. In this case, the distance a" from the virtual top dead center position ET2" of the center of piston pins of the cylinders of the second cylinder group to the top dead center position TDCM2" becomes the same as the distance a" from the virtual top dead center position ET1" of the centers of piston pins of the cylinders of the first cylinder group to the top dead center position TDCM1". The mechanical compression ratio of the second cylinder group and the mechanical compression ratio of the first cylinder group becomes equal.

Here, when the amounts of movement in the direction of the centerline of the engine CE are the same, the virtual top dead center position ET1 of the piston pin centers of the cylinders of the first cylinder group in the case where the centerline of the cylinder block CL separates from the centerline of the engine CE to the second cylinder group side becomes a position closer from the actual crank shaft center CC compared with the virtual top dead center position ET1" of the piston pin centers of the cylinders of the first cylinder group in the case where the centerline of the cylinder block CL matches the centerline of the engine CE. Therefore, as shown in FIG. 7, when the amounts of movement in the direction of the centerline of the engine CE are the same, due to the differences in the cylinder volumes at the top dead center crank angle (a1<a"), the mechanical compression ratio of the first cylinder group in the case where the centerline of the cylinder block CL separates from the centerline of the engine CE to the second cylinder group side becomes larger than the mechanical compression ratio of the first cylinder group in the case where the centerline of the cylinder block CL matches the centerline of the engine CE.

Further, when the amounts of movement in the direction of the centerline of the engine CE are the same, the virtual top dead center position ET2 of the piston pin centers of the cylinders of the second cylinder group in the case where the centerline of the cylinder block CL separates from the centerline of the engine CE to the second cylinder group side becomes a position further from the actual crank shaft center CC compared with the virtual top dead center position ET2" of the piston pin centers of the cylinders of the second cylinder group in the case where the centerline of the cylinder block CL matches the centerline of the engine CE, so as shown in FIG. 7, when the amounts of movement in the direction of the centerline of the engine CE are the same, due to the difference in cylinder volume of the top dead center crank angle (a2>a"), the mechanical compression ratio of the second cylinder group in the case where the centerline of the cylinder block CL separates from the centerline of the engine CE to the second cylinder group side becomes smaller than the mechanical compression ratio of the second cylinder group in the case where the centerline of the cylinder block CL matches the centerline of the engine CE.

In the variable compression ratio V-type internal combustion engine of the present embodiment, to change the mechanical compression ratio, as shown in FIG. 6, when changing the cylinder block 10 from the low position to the median position M', the first motor 39 of the first relative movement mechanism 30 is operated to make the first shaft 33 turn about the crankcase side support parts 33*b*. Due to this, the first relative movement mechanism 30, as a link mechanism with a single degree of freedom, through the cylinder block side support parts 33*a* which are eccentric with respect to the crankcase side support parts 33*b*, makes the first cylinder group side of the cylinder bock 10 move with respect to the crankcase 20 in the direction of engine centerline CE by exactly the first set distance Dv1. Simultaneously with this, the second motor 49 of the second relative movement mechanism 40 is operated to make the second shaft 44 turn. Due to this, the second relative movement mechanism 40, as a link mechanism with two degrees of freedom, through the eccentric bosses 43*c* which are eccentric with respect to the second shaft 44, uses the arms 43 to make the second cylinder group side of the cylinder block 10 move with respect to the crankcase 20 in the direction of the centerline of the engine CE by exactly a second set distance Dv2 smaller than the first set distance Dv1.

Since the first relative movement mechanism 30 is made a simple link mechanism with one degree of freedom, the cylinder block 10 is made to move with respect to the crankcase 20 upward (direction of centerline of engine CE) and simultaneously move by exactly the distance Dh to the second cylinder group side. With that, the centerline of the cylinder block CL becomes separated from the centerline of the engine CE in parallel to it. However, due to the second relative movement mechanism 40, at the cylinder block, compared with the first cylinder group side, the second cylinder group side is made to move upward slightly and the centerline of the cylinder block CL(M') is made to slant with respect to the centerline of the engine CE.

The first set distance Dv1 is an amount of displacement of the first cylinder group side of the cylinder block in the direction of the centerline of the engine for changing the mechanical compression ratio of the first cylinder group from the current mechanical compression ratio in the cylinder block at the low position L to the target mechanical compression ratio. This amount of displacement is realized by a link mechanism of a single degree of freedom, that is, the first relative movement mechanism 30, so is set considering the fact that, simultaneously, the centerline of the cylinder block CL moves to the second cylinder group side from the centerline of the engine CE by exactly the amount of movement determined by the amount of displacement in the direction of the centerline of the engine.

Further, the second set distance Dv2 is an amount of displacement of the second cylinder group side of the cylinder block in the direction of the centerline of the engine for changing the mechanical compression ratio of the second cylinder group from the current mechanical compression ratio in the cylinder block at the low position L to the target mechanical compression ratio. The centerline of the cylinder block CL moves to the second cylinder group side from the centerline of the engine CE, so as explained in FIG. 7, if making this amount of displacement the first set distance Dv1 the same as the first cylinder group side, the mechanical compression ratio of the second cylinder group ends up becoming smaller than the mechanical compression ratio of the first cylinder group, so it is made smaller than the first set distance Dvl, and the centerline of the cylinder block CL is made slanted with respect to the centerline of the engine CE.

For example, at the median position where the centerline of the cylinder block CL of FIG. 7 is separated from the centerline of the engine CE to the second cylinder group side, to make the amount of displacement in the direction of the centerline of the engine of the first cylinder group side larger than the amount of displacement in the direction of the centerline of the engine of the second cylinder group side, if considering the case of making the cylinder block turn (slant) in the clockwise direction about the front view crossing point BC (M) between the cylinder centerline of the first cylinder group and the cylinder centerline of the second cylinder group (displacement of first cylinder group side in direction of centerline of engine>Dv, while displacement of second cylinder group side in direction of centerline of engine<Dv), compared to before turning, the virtual top dead center position ET1 of the piston pin centers of the cylinders of the first cylinder group becomes further from the actual crank shaft center CC, the cylinder volume of the top dead center crank angle of the first cylinder group becomes larger, and the mechanical compression ratio of the first cylinder group becomes smaller. On the other hand, compared with before this turning, the virtual top dead center position ET2 of the piston pin centers of the cylinders of the second cylinder group becomes closer to the actual crank shaft center CC, so the cylinder volume of the top dead center crank angle of the second cylinder group becomes smaller, and the mechanical compression ratio of the second cylinder group becomes larger. In this way, at the median position where the centerline of the cylinder block CL separates from the centerline of the engine CE to the second cylinder group side, the centerline of the cylinder block CL is slanted with respect to the centerline of the engine CE so that the amount of displacement of the first cylinder group side in the direction of the centerline of the engine is made to become larger than the amount of displacement of the second cylinder group side in the direction of the centerline of the engine, whereby the mechanical compression ratio of the first cylinder group and the mechanical compression ratio of the second cylinder group can be made equal.

Figure 8:
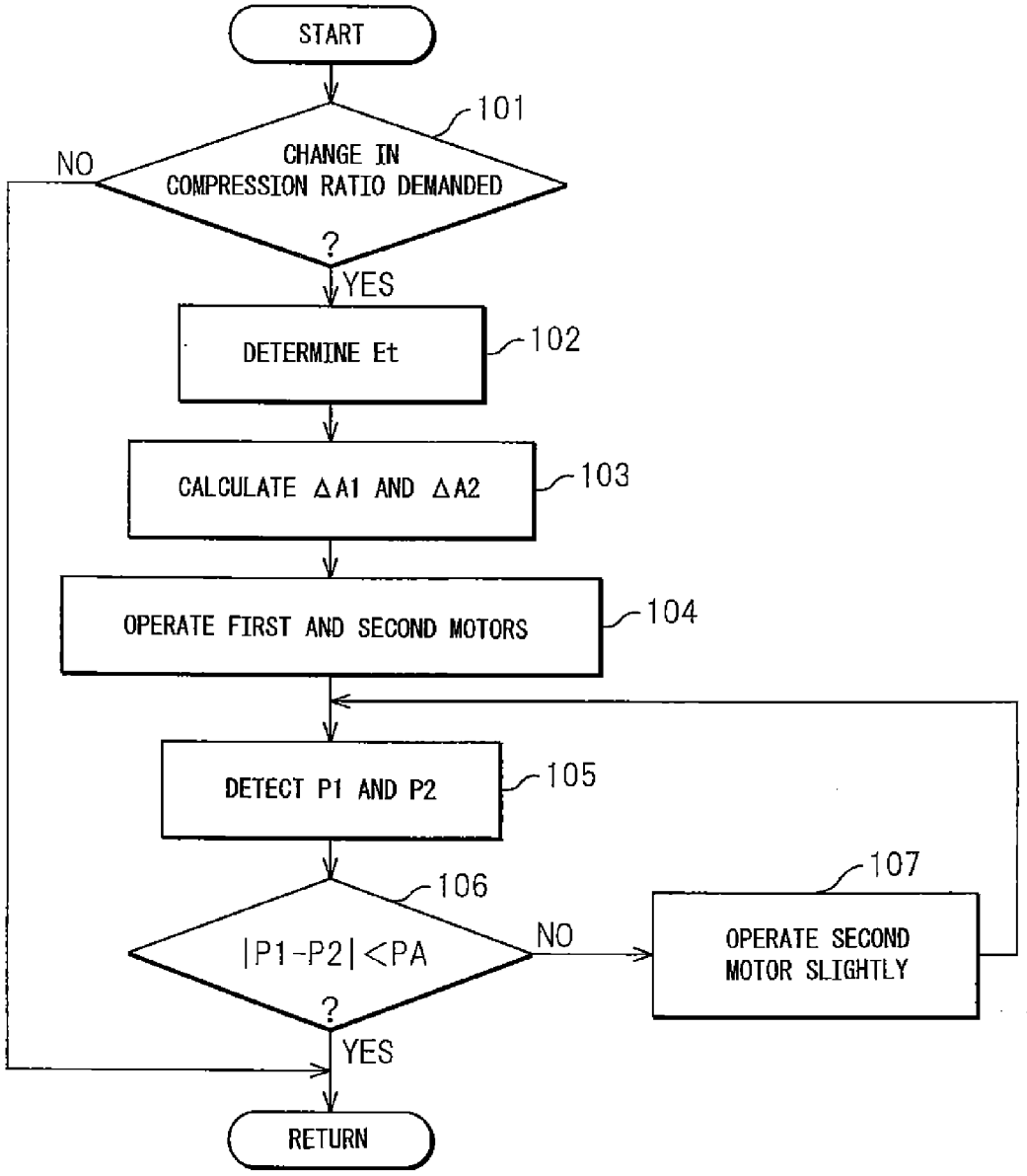
FIG. 8 is a flow chart for change of the mechanical compression ratio.

FIG. 8 is a flow chart for the use of the first relative movement mechanism 30 and the second relative movement mechanism 40 to change the compression ratio in the variable compression ratio V-type internal combustion engine. The first relative movement mechanism 30 and the second relative movement mechanism 40 are controlled by an electronic control unit comprised of a digital computer. The electronic control unit, for example, has various types of sensors connected to it such as a load sensor which detects the amount of depression of an accelerator pedal as the engine load, a rotary sensor which detects the engine speed, a water temperature sensor which detects the cooling water temperature, and an intake temperature sensor which detects an intake temperature.

First, at step 101, it is judged if a change of the mechanical compression ratio has been demanded. The target mechanical compression ratio is set based on the engine load, engine speed, intake air amount, closing timing of the intake valve, etc. For example, the target mechanical compression ratio is set so as to become higher the lower the engine load.

When the judgment at step 101 is negative, the routine is ended as it is, but, for example, when the engine load changes and change of the mechanical compression ratio is demanded, the judgment at step 101 is affirmative. At step 102, a new target mechanical compression ratio Et is determined. Next, at step 103, the deviation ΔA1 (Alt−A1) between the amount of displacement Alt of the first cylinder group side of the cylinder block which was preset for realizing the target mechanical compression ratio Et at the first cylinder group (for example, the amount of displacement in the direction of the centerline of the engine from the lowest position of the cylinder block) and the current displacement amount A1 (for example, the amount of displacement in the direction of the centerline of the engine from the lowest position of the cylinder block) and the deviation ΔA2 (A2t−A2) between the amount of displacement A2t of the second cylinder group side of the cylinder block which was preset for realizing the target mechanical compression ratio Et at the second cylinder group (for example, the amount of displacement in the direction of the centerline of the engine from the lowest position of the cylinder block) and the current displacement amount A2 (for example, the amount of displacement in the direction of the centerline of the engine from the lowest position of the cylinder block) are calculated.

Next, at step 104, the first motor 39 of the first relative movement mechanism 30 is operated to make the first cylinder group side of the cylinder block move relatively by exactly the deviation ΔA1, and the second motor 49 of the second relative movement mechanism 40 is operated to make the second cylinder group side of the cylinder block move relatively by exactly the deviation ΔA2. Here, when the target mechanical compression ratio Et is smaller than the current mechanical compression ratio E, the deviations ΔA1 and ΔA2 become plus values so the first cylinder group side and the second cylinder group side of the cylinder block are made to rise, that is, to move away from the crank shaft. Further, when the target mechanical compression ratio Et is larger than the current mechanical compression ratio E, the deviations ΔA1 and ΔA2 become minus values so that cylinder block is made to descend, that is, to approach the crank shaft.

In this way, when the mechanical compression ratios of the first cylinder group and the second cylinder group are changed, at step 105, the first combustion pressure P1 representing the first cylinder group and the second combustion pressure P2 representing the second cylinder group are detected. The first combustion pressure P1 may, for example, be the combustion pressure of one cylinder in the first cylinder group which is measured by a combustion pressure sensor, or may be the average of the measured combustion pressures of all cylinders of the first cylinder group. The second combustion pressure P2 also, for example, may be the combustion pressure of one cylinder in the second cylinder group which is measured by a combustion pressure sensor, or may be the average of the measured combustion pressures of all cylinders of the second cylinder group.

Next, at step 106, it is judged if the absolute value of the difference of the first combustion pressure P1 and the second combustion pressure P2 is smaller than the set value PA. If the judgment is affirmative, that is, the difference of the first combustion pressure P1 and the second combustion pressure P2 is within the allowable range, the routine is ended as is. However, if the judgment at step 106 is negative, that is, the difference of the first combustion pressure P1 and the second combustion pressure P2 is outside of the allowable range, until the difference of the first combustion pressure P1 and the second combustion pressure P2 becomes within the allowable range, just the second motor 49 of the second relative movement mechanism 40 is slightly operated to make just the mechanical compression ratio of the second cylinder group change slightly to make the second combustion pressure P2 approach the first combustion pressure P1 (strictly speaking, the mechanical compression ratio of the first cylinder group also changes by a much smaller amount than the change of the mechanical compression ratio of the second cylinder group in the same direction, but the change is of an extent which can substantially be ignored). For example, when the second combustion pressure P2 is higher than the first combustion pressure P1 and the difference of the first combustion pressure P1 and the second combustion pressure P2 is outside of the allowable range, just the amount of displacement of the second cylinder group side of the cylinder block is made larger so as to lower just the mechanical compression ratio of the second cylinder group. Further, when the second combustion pressure P2 is lower than the first combustion pressure P1 and the difference of the first combustion pressure P1 and the second combustion pressure P2 are outside of the allowable range, just the amount of displacement of the second cylinder group side of the cylinder block is made smaller so as to raise just the mechanical compression ratio of the second cylinder group.

In this way, when the mechanical compression ratio is changed, the difference of the first combustion pressure P1 and the second combustion pressure P2 is made to enter the allowable range by feedback control of just the displacement of the second cylinder group side of the cylinder block. Of course, when the mechanical compression ratio is changed, the difference of the first combustion pressure P1 and the second combustion pressure P2 may also be made to enter the allowable range by slightly operating the first motor 39 of the first relative movement mechanism 30 and performing feedback control of just the amount of displacement of the first cylinder group side of the cylinder block.

The present embodiment explained the case where when making the cylinder block 10 move relative to the crankcase 20 in the direction of the centerline of the engine, if left alone, the centerline of the cylinder block CL separated from the centerline of the engine CE to the second cylinder group side. However, of course, when making the cylinder block 10 move relative to the crankcase 20 in the direction of the centerline of the engine CE, if left alone, the centerline of the cylinder block CL may separate from the centerline of the engine CE to the first cylinder group side. In this case, if making the amount of displacement Dv1 of the first cylinder group side in the direction of the centerline of the engine smaller than the amount of displacement Dv2 of the second cylinder group side in the direction of the centerline of the engine by making the centerline of the cylinder block CL slant with respect to the centerline of the engine CE, it is also possible to make the mechanical compression ratio of the first cylinder group and the mechanical compression ratio of the second cylinder group equal.

Reference Signs List

10 cylinder block
20 crankcase
30 first relative movement mechanism
40 second relative movement mechanism

The invention claimed is:

1. A variable compression ratio V-type internal combustion engine which joins cylinder blocks of two cylinder groups and makes the joined cylinder blocks move relatively to a crankcase, wherein said variable compression ratio V-type internal combustion engine comprising a first relative movement mechanism which makes one cylinder group side of said cylinder block move relatively and a second relative movement mechanism which makes the other cylinder group side of said cylinder block move relatively, said first relative movement mechanism and said second relative movement mechanism being able to be independently controlled, and a first relative movement distance at one cylinder group side of said cylinder block in the engine centerline direction passing through the center of the crank shaft as seen in the front plan view caused by said first relative movement mechanism and a second relative movement distance at the other cylinder group side of said cylinder block in said engine centerline direction caused by said second relative movement mechanism being able to made different.

2. A variable compression ratio V-type internal combustion engine according to claim 1, wherein said first relative movement mechanism is a link mechanism which has one degree of freedom and in that said second relative movement mechanism is a link mechanism which has two degrees of freedom.

3. A variable compression ratio V-type internal combustion engine according to claim 1, wherein said first relative movement distance and said second relative movement distance are changed, the difference between a combustion pressure representing one cylinder group and a combustion pressure representing the other cylinder group is made to become within an allowable range by using said first relative movement mechanism for feedback control of said first relative movement distance or by using said second relative movement mechanism for feedback control of said second relative movement distance.

4. A variable compression ratio V-type internal combustion engine according to claim 2, wherein said first relative movement distance and said second relative movement distance are changed, the difference between a combustion pressure representing one cylinder group and a combustion pressure representing the other cylinder group is made to become within an allowable range by using said first relative movement mechanism for feedback control of said first relative movement distance or by using said second relative movement mechanism for feedback control of said second relative movement distance.

* * * * *